US006490797B1

(12) United States Patent
Lake et al.

(10) Patent No.: US 6,490,797 B1
(45) Date of Patent: Dec. 10, 2002

(54) BLADE LOCK FOR FOLDING KNIFE

(75) Inventors: Ronald W. Lake, Eugene, OR (US); Michael L. Walker, Taos, NM (US)

(73) Assignee: Imperial Schrade Corp., Ellenville, NY (US)

( * ) Notice: Subject to any disclaimer, the term of this patent is extended or adjusted under 35 U.S.C. 154(b) by 0 days.

(21) Appl. No.: 09/530,999

(22) PCT Filed: Sep. 27, 1999

(86) PCT No.: PCT/US99/22310

§ 371 (c)(1),
(2), (4) Date: May 8, 2000

(87) PCT Pub. No.: WO00/18549

PCT Pub. Date: Apr. 6, 2000

Related U.S. Application Data

(60) Provisional application No. 60/102,172, filed on Sep. 28, 1998, and provisional application No. 60/118,654, filed on Jan. 26, 1999.

(51) Int. Cl.[7] ..... B26B 1/04
(52) U.S. Cl. ..... 30/161; 30/160
(58) Field of Search ..... 30/155, 158, 159, 30/160, 161

(56) References Cited

U.S. PATENT DOCUMENTS

| | | | | | |
|---|---|---|---|---|---|
| 825,093 | A | * | 7/1906 | Watson | 30/161 |
| 1,075,519 | A | | 10/1913 | Tillmanns | |
| 1,512,689 | A | | 10/1924 | Hermann | |
| 1,521,778 | A | | 1/1925 | McLay | |
| 1,734,126 | A | | 11/1929 | Guttzeit | |
| 4,354,313 | A | | 10/1982 | Naifeh | |
| 4,896,424 | A | * | 1/1990 | Walker | 30/161 |
| 4,947,552 | A | * | 8/1990 | Barnes | 30/161 |
| 5,093,995 | A | | 3/1992 | Jan | 30/161 |
| 5,502,895 | A | | 4/1996 | Lemaire | 30/158 |
| 5,537,750 | A | | 7/1996 | Seber et al. | 30/161 |
| 5,546,662 | A | | 8/1996 | Seber et al. | 30/161 |
| 5,581,834 | A | | 12/1996 | Collins | 30/161 |
| 5,596,808 | A | * | 1/1997 | Lake et al. | 30/161 |
| 5,685,079 | A | | 11/1997 | Brothers et al. | 30/161 |
| 5,699,615 | A | | 12/1997 | Chen | 30/160 |
| 5,755,035 | A | * | 5/1998 | Weatherly | 30/161 |
| 5,802,722 | A | | 9/1998 | Maxey et al. | 30/160 |
| 5,875,552 | A | | 3/1999 | Chen | 30/161 |

FOREIGN PATENT DOCUMENTS

| | | |
|---|---|---|
| DE | 20335 | 12/1882 |
| FR | 1051848 | 1/1954 |
| GB | 124157 | 3/1919 |

* cited by examiner

*Primary Examiner*—Hwei-Siu Payer
(74) *Attorney, Agent, or Firm*—Saidman DesignLaw Group

(57) ABSTRACT

A knife blade is locked by selectively moving a blade locking mechanism into and out of alignment with the end surface of the blade. The blade locking mechanism is replaceably mounted on the free end of a spring formed as a part of one of the side panels. The blade locking mechanism is preferably a disc which seats into a conical recess in the end of the blade.

61 Claims, 10 Drawing Sheets

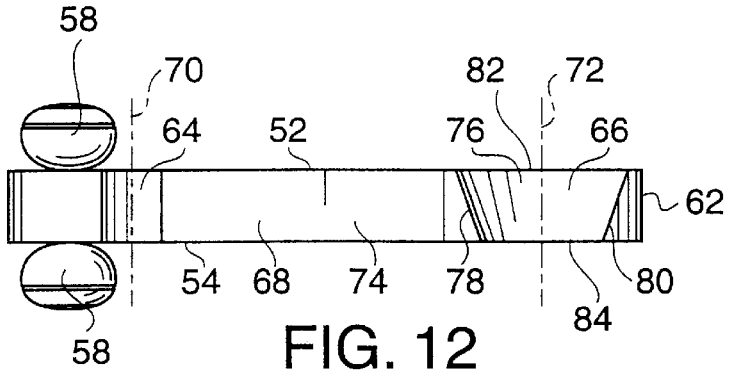
FIG. 12
FIG. 13
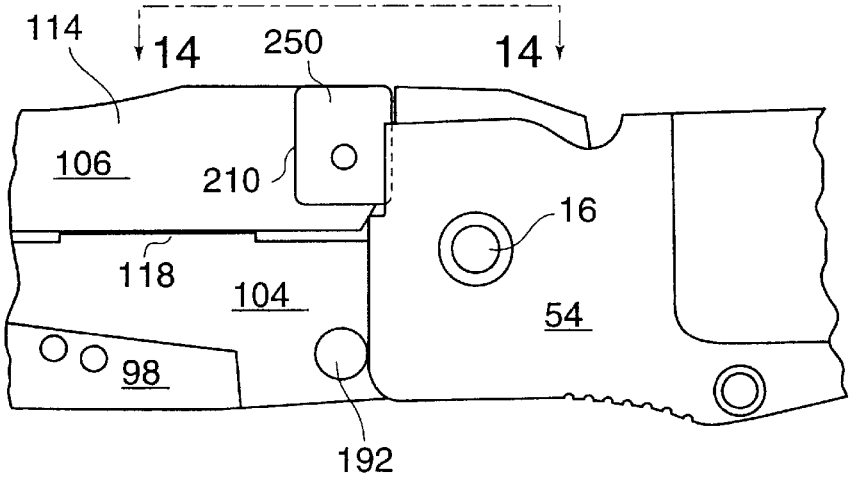
FIG. 14
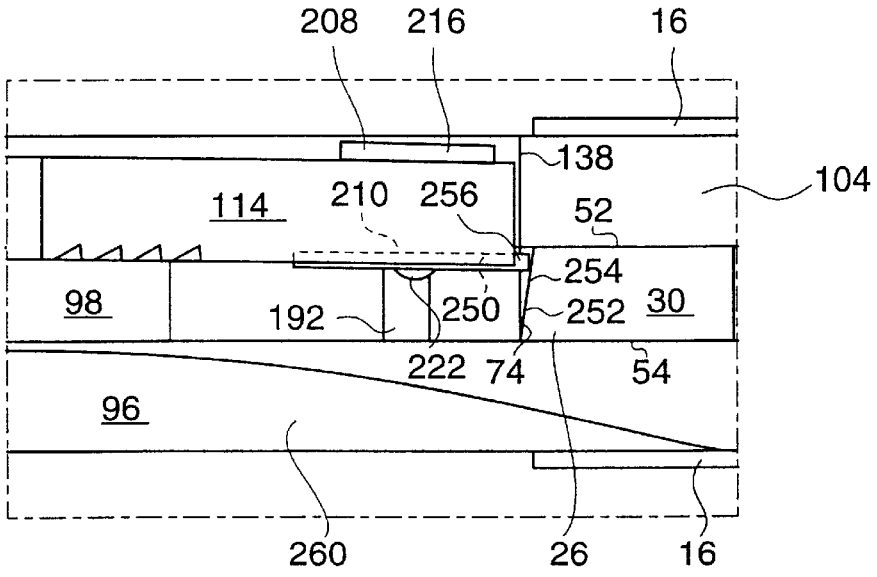

BLADE LOCK FOR FOLDING KNIFE

CROSS-REFERENCE TO RELATED APPLICATIONS

This application claims priority from our prior U.S. provisional application Ser. No. 60/102,172, filed Sep. 28, 1998, and from our prior U.S. provisional application Ser. No. 60/118,654, filed Jan. 26, 1999.

TECHNICAL FIELD

This invention relates to a folding knife and, more particularly, to a locking mechanism for a folding knife.

BACKGROUND ART

Locking mechanisms for knife blades have been around almost as long as knives themselves. Most use a spring element, or spring biased element, moving in the plane of the knife as a locking element. Hallverson, U.S. Pat. No. 1,365,487, and Guttzeit, U.S. Pat. No. 1,734,126, are examples.

Another type of known locking mechanism moves laterally to the plane of the knife. Examples include: McLay, U.S. Pat. No. 1,521,778; Walker, U.S. Pat. No. 4,896,424; and Chen, U.S. Pat. No. 5,699,615. McLay provides a three-piece side panel, one piece of which is a spring-biased lever having a locking flange at one end. The flange is moved into and out of apertures in the tang of the blade to effect locking. Such movement is produced by a plate on the opposite end of the lever. Inadvertent squeezing of the plate could cause closure of the blade, perhaps on the fingers of the user. Walker and Chen both provide a deflectable spring lock internally of the knife handle. Both also require an extra element for the locking mechanism in addition to their side panels. And, in each, the tip of the spring coacts directly with the blade to effect locking.

DISCLOSURE OF THE INVENTION

It is a primary object of the present invention to provide a blade lock for a folding knife that is easy and safe to use.

It is another object of the present invention to provide a blade lock for a folding knife which securely locks the knife blade in an open position even as the blade lock wears from use.

It is another object of the present invention to provide a blade lock having replaceable parts, thereby further prolonging the useful life of the folding knife.

It is another object of the present invention to provide a blade lock for a folding knife that is simple and economical to manufacture.

These and other objects are achieved in accordance with one aspect of the present invention by providing a blade lock for a folding knife wherein the spring which biases the lock into locking engagement with the blade is a part of one of the side panels of the folding knife.

In accordance with another aspect of the present invention, there is provided a blade lock for a folding knife wherein the locking element is replaceably mounted on the free end of the spring.

In accordance with another aspect of the present invention, there is provided a blade lock for a folding knife wherein the locking element is more wear-resistant than the side panels, substantially reducing the production costs of the knife.

Finally, in accordance with a more specific aspect of the present invention, there is provided a blade lock for a folding knife wherein the locking element comprises a disc coacting with a conical recess provided in the end face of the blade, so that as the disc wears, it will maintain an efficacious lock merely by seating deeper into the recess.

BRIEF DESCRIPTION OF THE DRAWINGS

The foregoing and other objects, aspects, uses, and advantages of the present invention will be more fully appreciated as the same becomes better understood from the following detailed description of the present invention when viewed in conjunction with the accompanying drawings, in which:

FIG. 12 is an end view of the blade of the preferred embodiment taken along lines 12—12 of FIG. 17;

FIG. 13 is an enlarged partial sectional view similar to FIG. 10 but showing a second embodiment of the present invention;

FIG. 14 is an enlarged bottom view of the second embodiment taken along line 14—14 of FIG. 13 but shown fully assembled;

MODES FOR CARRYING OUT THE INVENTION

Figure 1:
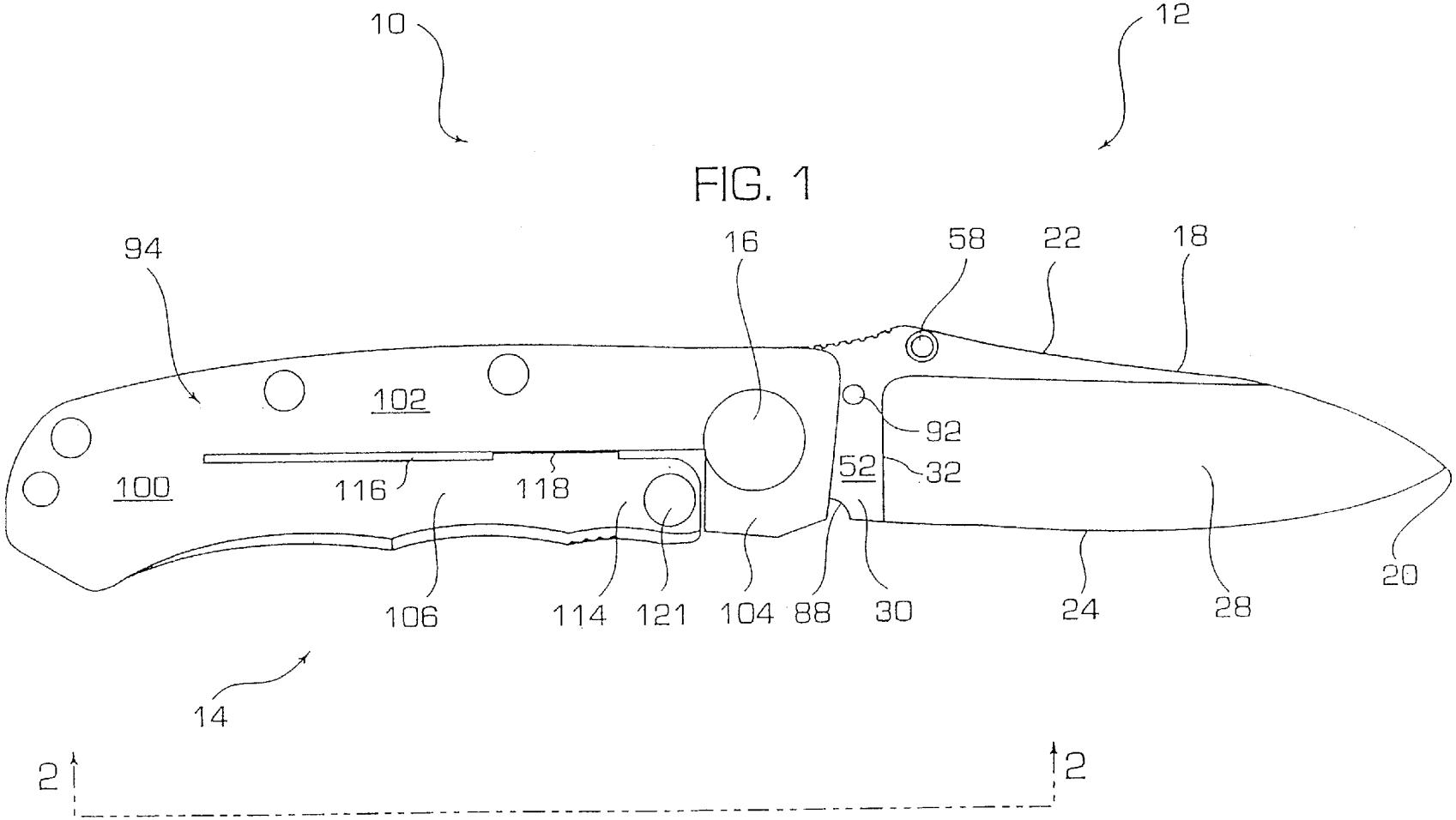
FIG. 1 is a front side view of a preferred embodiment of the present invention.

Referring first to FIG. 1, there is illustrated a preferred embodiment of the present invention which comprises a folding knife indicated generally by reference numeral 10. Folding knife 10 includes a blade 12 and a handle 14, pivotally joined together by a pivot pin 16.

Initially, blade 12 will be described with reference to FIGS. 1–4 and 17. Then the structure of handle 14 will be set forth. Finally, the operation of the present invention will be described, along with alternate embodiments.

Figure 2:
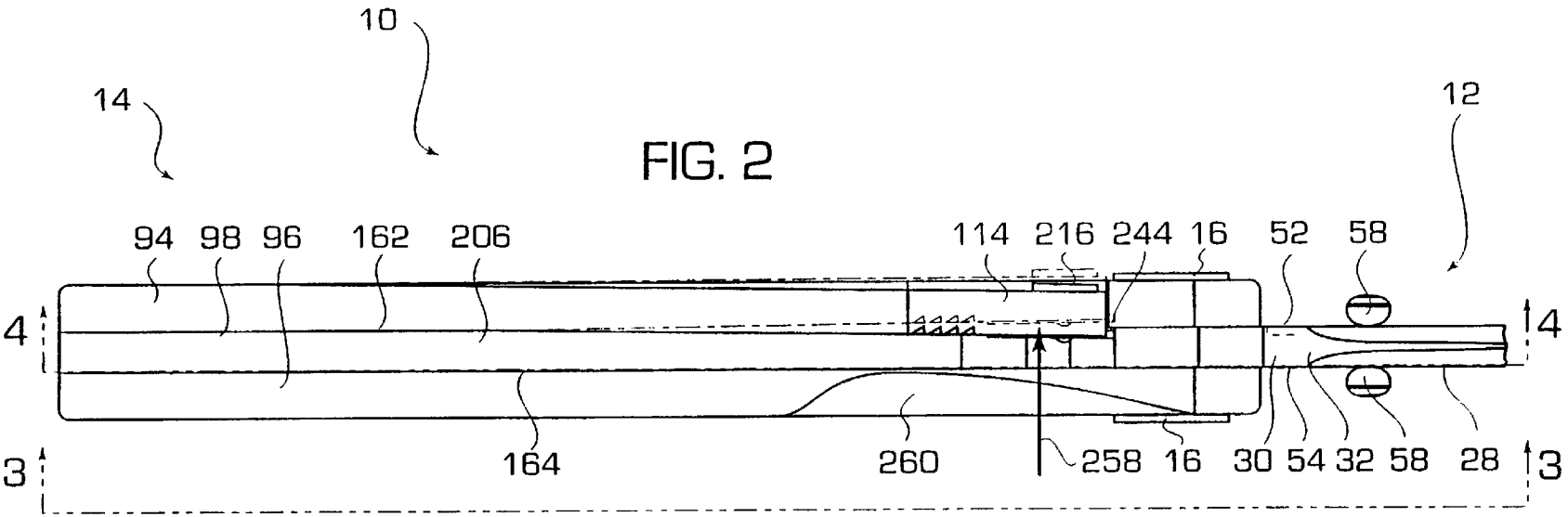
FIG. 2 is a bottom view of the preferred embodiment taken along line 2—2 of FIG. 1.
Figure 4:
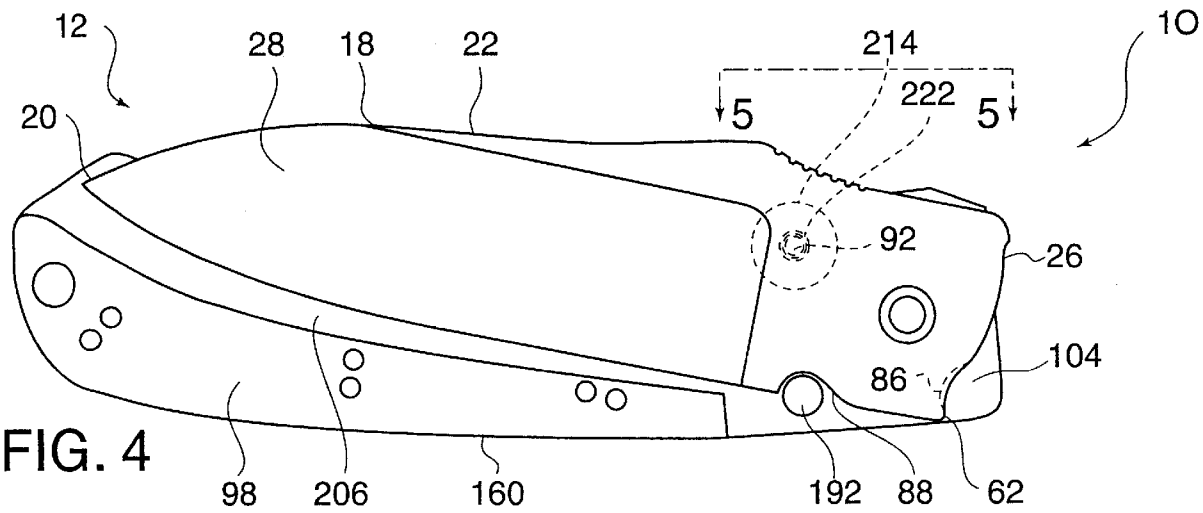
FIG. 4 is a sectional view of the preferred embodiment taken along line 4—4 of FIG. 2 but shown with the blade folded for storage.
Figure 17:
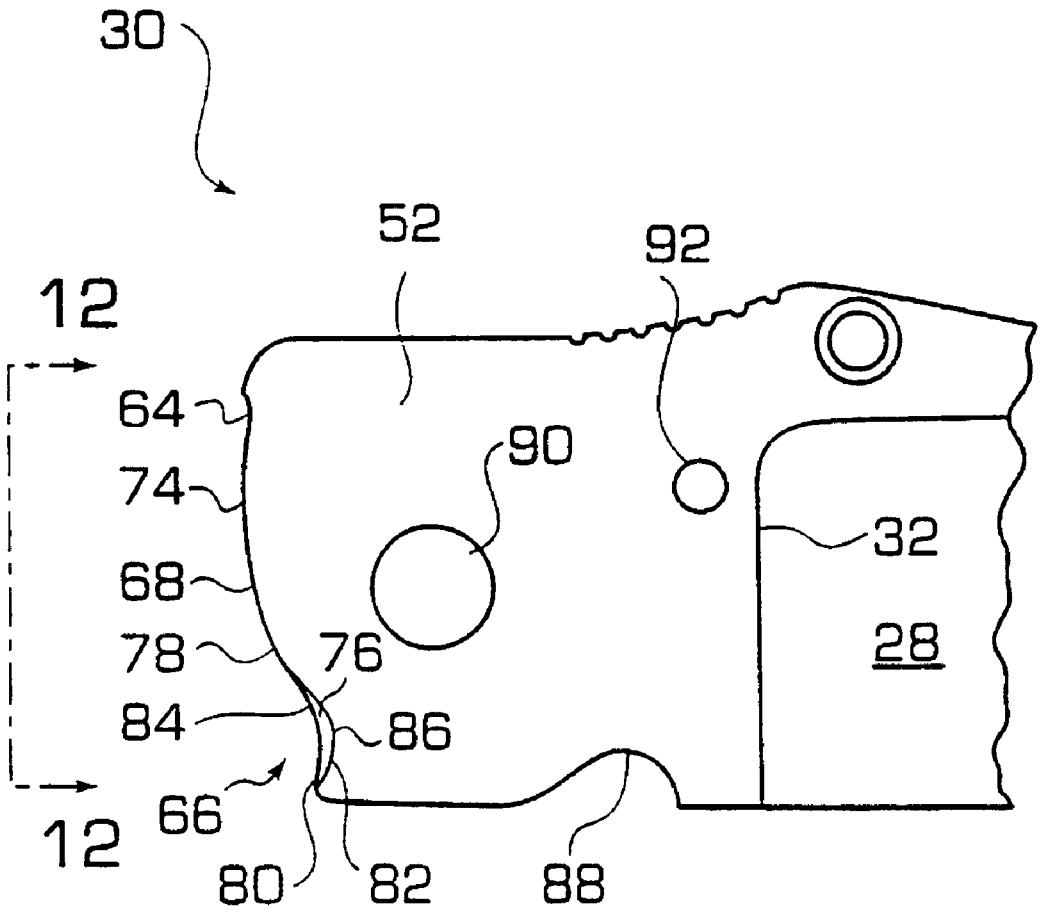
FIG. 17 is an enlarged partial side view of the blade of the preferred embodiment showing the side opposite to that shown in FIGS. 4, 6, 8 and 10.

As is customary in folding knives, blade 12 is an integral structure which is elongated, relatively narrow, and very thin, as can be seen by comparing the side view in FIG. 1 and the partial edge view in FIG. 2. Blade 12 is bounded by a perimeter 18 which comprises a pointed tip 20, an upper edge 22, a lower edge 24, and a rear edge 26 (FIGS. 4 and 17). Within perimeter 18, blade 12 can be conceptually divided into two portions, a working portion indicated generally by reference numeral 28, and a tang indicated generally by reference numeral 30. Tang 30 includes opposite side surfaces 52 and 54. Working portion 28 and tang 30 merge along a vertical boundary 32. (Unless otherwise indicated, all references to "upper", "lower", "rear", "vertical" and similar terms of relative directions are with reference to the orientation of the folding knife as shown in FIG. 1).

Working portion 28 of blade 12 is conventional and need not be described in detail. As is known in the art, folding knife blades come in an endless variety of shapes and sizes, many of which can be used in conjunction with the present invention. A pair of rounded protrusions 58 (FIGS. 1–3 and 12) may be provided on opposite sides of blade 12 to facilitate user manipulation of blade 12.

The configuration of tang 30 will now be described in conjunction with FIG. 4 which shows a side view of the entirety of blade 12, FIG. 17 which shows the opposite side to that shown in FIG. 4, and FIG. 12 which shows an end view of tang 30 as seen along lines 12—12 of FIG. 17.

Referring particularly to FIG. 17, flat upper edge 40 of tang 30 extends to rounded corner 34. The profile of end 26 includes a concave blade-stop recess 64 and a blade-lock recess 66, both carved in a lazy S-shaped curve 68 along end 26. Blade-stop recess 64 is preferably a section of a cylinder whose axis 70 (FIG. 12) is perpendicular to the parallel, opposed sides 52 and 54 of tang 30. In accordance with the present invention, blade-lock recess 66 is preferably shaped in the form of a conical section whose axis 72 (FIG. 12) is also perpendicular to sides 52 and 54. Conical blade-lock recess 66 is an important feature of the present invention, and therefore will be described in more detail.

Because axis 72 of conical recess 66 is preferably perpendicular to sides 52 and 54 of tang 30, it is also parallel to the rearwardly facing surface 74 of end 26. Thus, conical recess 66 forms an asymmetrically curved depression 76 in rearwardly facing surface 74. As is clear from FIG. 12, the intersection of depression 76 with surface 74 defines linear edges 78 and 80 which converge as they traverse end 26 from side 52 to side 54. Depression 76 also intersects with sides 52 and 54 at a pair of arcuate edges 82 and 84, respectively. Since depression 76 comprises a section of a cone, edge 82 is longer than edge 84 and is spaced further from surface 74. In other words, asymmetrically curved depression 76 uniformly drops away from edge 84 of side 54 while uniformly expanding as it approaches edge 82 of side 52. When viewing tang 30 from the side (FIG. 17), depression 76 therefore appears as a moon-shaped sliver 86 opening toward side 52. Sliver 86 is also shown in phantom in FIGS. 4, 6, 8, and 10.

It should be noted that while recess 66 is preferably conical in shape, other shapes and configurations are possible, such as an inclined ramp, which will be described in greater detail hereinafter.

Completing the description of tang 30 in FIG. 17, the lower edge of tang 30 includes an asymmetrically arcuate notch 88, the function of which will be explained. A cylindrical aperture 90 extends through tang 30 through which pivot pin 16 is journaled. A blind hole 92 is formed on side 52 in tang 30 and is spaced a specified distance from aperture 90 for a purpose which will become clear hereinafter. Finally, indicated by reference numeral 32 is the transverse boundary between tang 30 and working portion 28.

Returning to FIGS. 1–3, a preferred embodiment of handle 14 will now be described. Handle 14 comprises three main components: two side panels 94 and 96 and a spacer 98 therebetween.

Side panel 94 (FIG. 1) is preferably made of a slightly resilient material and comprises an integrally formed, bifurcated sheet comprising a base 100, an elongated body 102 integrally extending from base 100, a pivot end 104, and an elongated blade-locking spring 106 also integrally extending from base 100. In the preferred embodiment, side panel 94 is fastened to spacer 98 along base 100 and body 102 by suitable screws or the like. Pivot end 104 includes a back edge 138 and is held non-flexibly in place by pivot pin 16. Spring 106 includes a fixed end which extends integrally from base 100 and a free end 114 which is given an initial bias inwardly towards the internal portion of handle 14 (i.e., into the plane of the paper in FIG. 1). This bias is preferably sufficiently strong such that free end 114 of spring 106 will continue to move inwardly until constrained against further movement by another structural element of knife 10.

Spring 106 and body 102 both extend between base 100 and pivot end 104 and are substantially parallel, separated by a longitudinally formed slot 116. Optionally, a ridge 118 may be provided to guide contact between body 102 and free end 114 for increased stability when the latter is flexing. Ridge 118 also prevents disengagement of the locking mechanism (to be described in greater detail below) by keeping spring 106 from flexing upwardly (FIG. 1) when blade 12 is torqued. Ridge 118 can be formed integral with spring 106, as in FIG. 1, or, preferably, with body 102, as in FIGS. 6, 8, 10, and 13. In accordance with the present invention, a blade locking mechanism, indicated generally by reference numeral 121 and to be described in detail hereinafter, is replaceably attached to free end 114.

Figure 6:
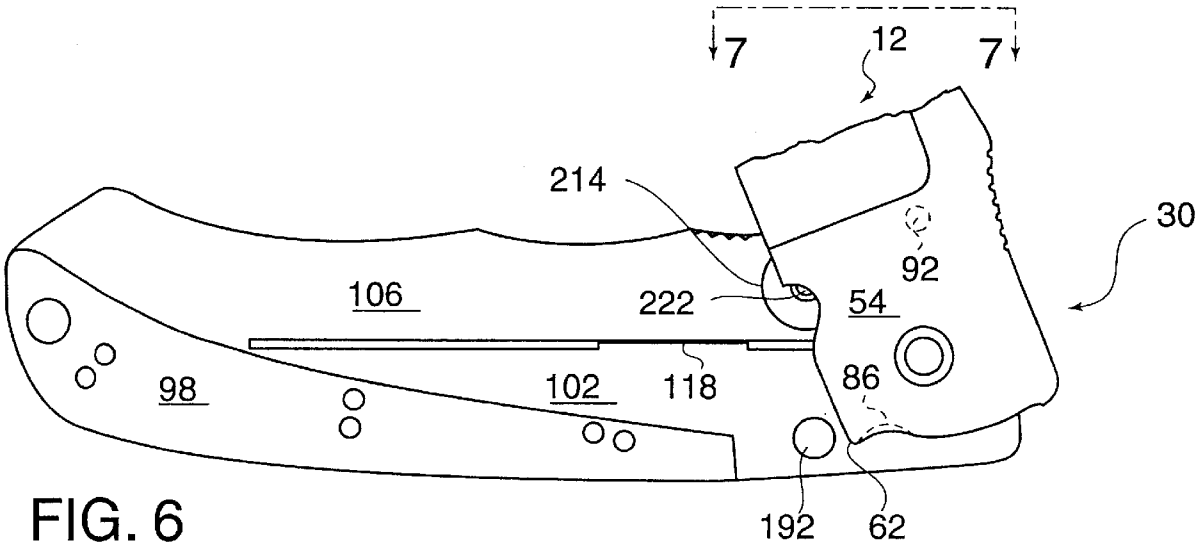
FIG. 6 is similar to FIG. 4 but showing the blade slightly less than half opened (with the working end of the blade omitted)

Side panel 96 (FIG. 3) preferably comprises a solid sheet made of the same material as side panel 94 and is fastened to spacer 98 by suitable screws or the like. Spacer 98 (FIG. 4) preferably comprises a unitary rigid body 160 having parallel side walls 162 and 164 (FIG. 2). At the forward end of handle 14 is a stop pin 192 (FIGS. 4 and 6).

Pivot pin 16 passes through pivot end 104 of side panel 94, tang 30, and side panel 96. The preferred embodiment of pivot pin 16 comprises a suitable nut and screw assembly or the like.

When the side panels and spacer of knife 10 are assembled, an interior cavity 206 (FIG. 2) is formed therebetween to provide a storage space for blade 12 when knife 10 is closed, as seen in FIG. 4.

Figure 15:
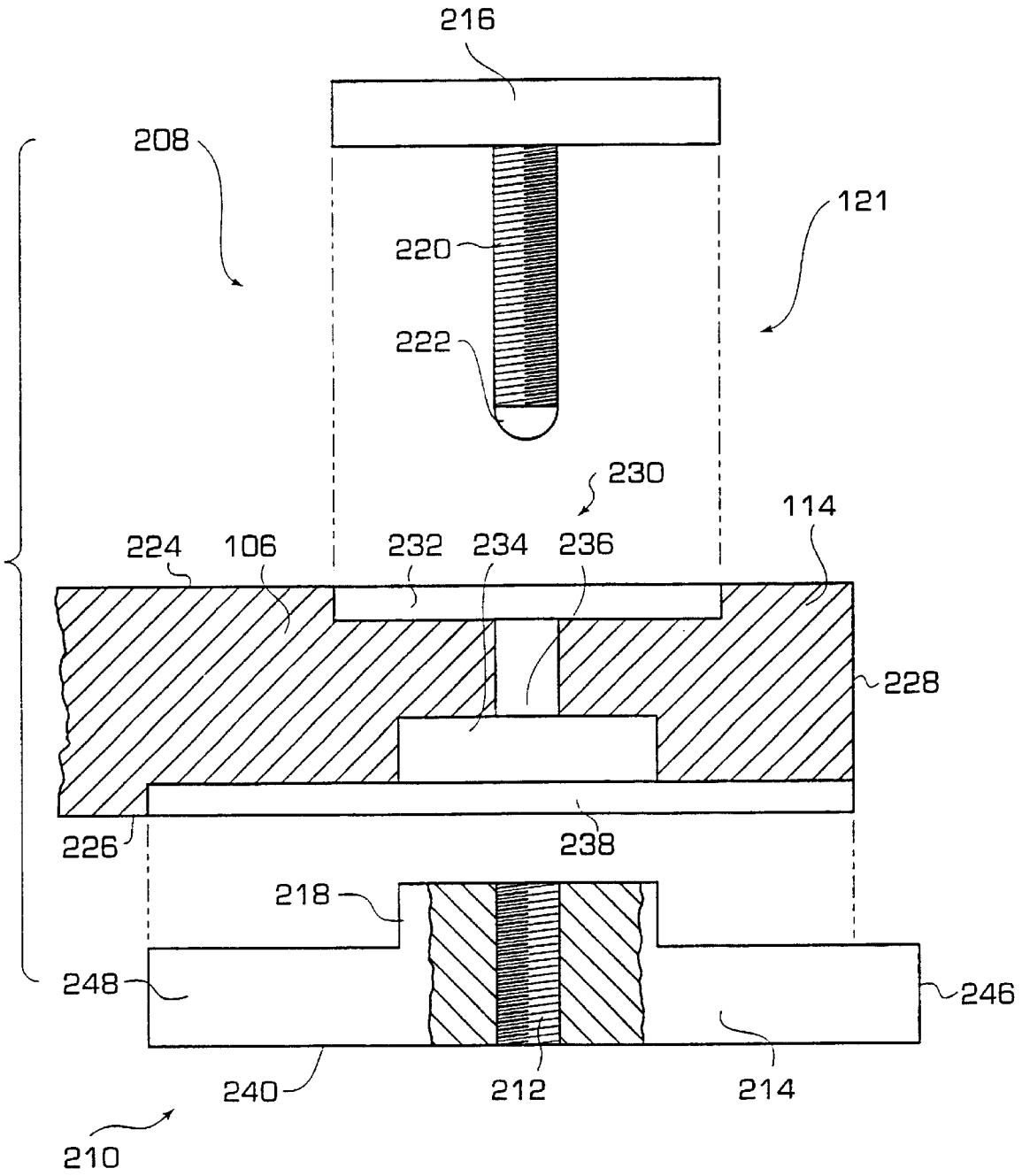
FIG. 15 is an exploded, enlarged partial side view showing the locking mechanism of the preferred embodiment of the present invention.
Figure 16:
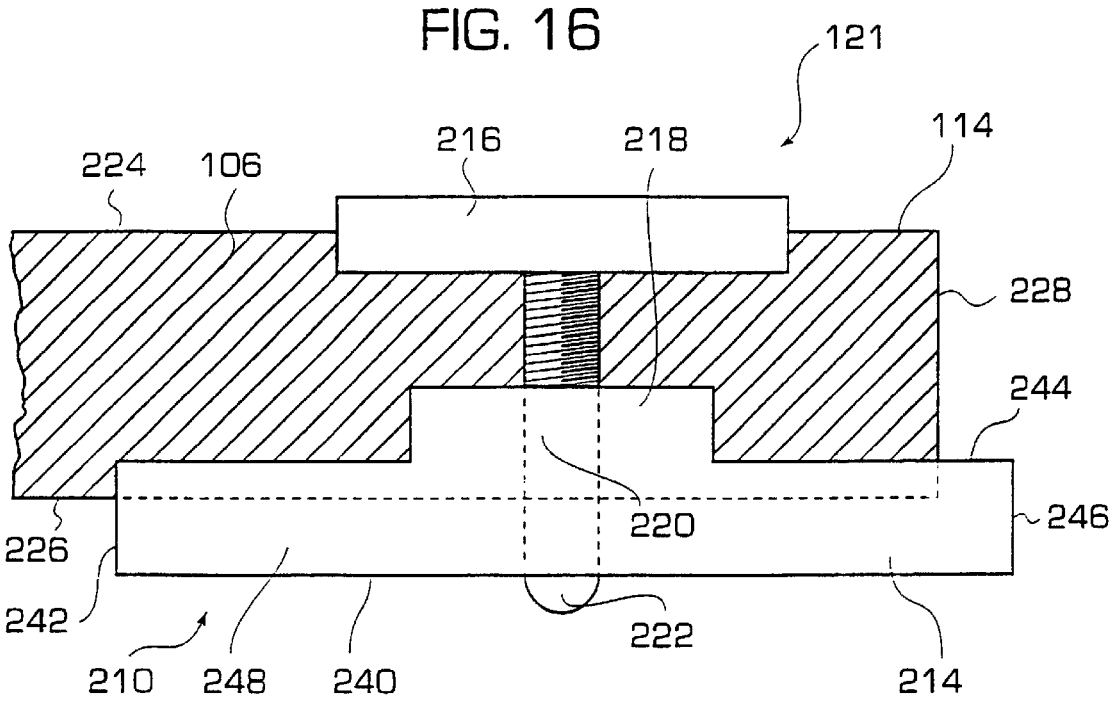
FIG. 16 is view like FIG. 15 but showing the parts assembled.

A preferred embodiment of the locking mechanism 121 of the present invention which positively locks the blade in its fully open position will now be described with reference initially to FIGS. 15–16. Locking mechanism 121 comprises a mounting screw 208 and a wear-resistant end portion 210 (shown partially broken away in FIG. 15 to show an internally threaded aperture 212). In the preferred embodiment, end portion 210 comprises a circular disc 214 (FIG. 10) and a stepped down circular shoulder 218, both being made of metal, ceramic, or other wear-resistant material. Mounting screw 208 comprises, sequentially from the top, an enlarged circular, disc-shaped head 216, a cylindrical threaded shaft 220, and a rounded, approximately hemispherical bearing tip 222. Head 216, shaft 220, and bearing tip 222 are coaxially aligned and preferably comprise an integral, unitary component.

Free end 114 of spring 106 comprises an exteriorly facing surface 224 which faces outwardly from handle 14, an interiorly facing surface 226 which faces toward interior cavity 206 (FIG. 4), and an end surface 228. A transverse aperture 230 extends through free end 206 from exterior surface 224 to interior surface 226. Aperture 230 preferably includes an outer, disc-shaped recess 232 having a diameter equal to the diameter of head 216 and an axial depth somewhat less than the axial thickness of head 216; a cylindrical orifice 236 of a diameter slightly larger than that of shaft 220; a stepped-down, intermediate disc-shaped recess 234 of the same diameter and axial thickness as shoulder 218, an inner disc-shaped recess 238 in surface 226 having the same diameter as wear-resistant disc 214 and axial depth slightly less than the axial thickness of disk 214.

Locking mechanism 121 is mounted on spring 106 by passing externally threaded shaft 220 through cylindrical orifice 236 and threading it into internally threaded aperture 212 of disc 214, thereby securing mounting screw 208 and disc 214 to free end 114. Hemispherical tip 222 is of a size to pass freely through both unthreaded aperture 230 and threaded aperture 212 and protrudes below outer surface 240 of disc 214 (FIG. 16). When disc 214 is secured to spring 106, a portion 242 of disc 214 protrudes from interior surface 226. Similarly, a chordal segment 244 and an annular surface 246 which extends around the perimeter 248 of disc 214 also protrude beyond end surface 228. As will become more clear hereinafter, and in accordance with the present invention, the protrusion of portion 242, chordal segment 244 and annular surface 246 avoids wear on the relatively soft material of which free end 114 of spring 106 is made.

As will be explained in detail herein, hemispherical bearing tip 222 and blind hole 92 act as a spring-loaded detent which constrains blade 12 in a folded position. Conventionally designed folding knives used a spring-compressed ball (see e.g., Chen, supra). Hemispherical tip 222 represents a significant improvement over conventional design. Integrating hemispherical tip 222 into mounting screw 208, decreases manufacturing costs by simplifying assembly and reducing the number of parts to be manufactured.

Use of circular disc 214 also greatly simplifies the manufacturing process of knife 12. Conventional locking mechanisms (such as locking springs of the kind shown in Chen, supra) are relatively expensive to produce because they must be machined to very precise tolerances, which must be custom-tooled for each different knife model, in order to tightly lock blade 12. In contrast, the manufacturer of a knife using locking mechanism 121 need only keep a selection of circular disks 214 of varying diameters on hand and select the diameter which provides the best fit. In addition, a cylindrical shape, such as circular disk 214 is much simpler to machine than the squared-off surfaces of conventional designs.

The operation of the preferred embodiment of the present invention will now be described with reference to FIGS. 4–11. Initially, knife 10 is shown in its closed of folded state in FIGS. 4–5. The sharp edges of blade 12, i.e., tip 20 and working portion 28, are tucked away safely within cavity 206 of handle 14.

Figure 5:
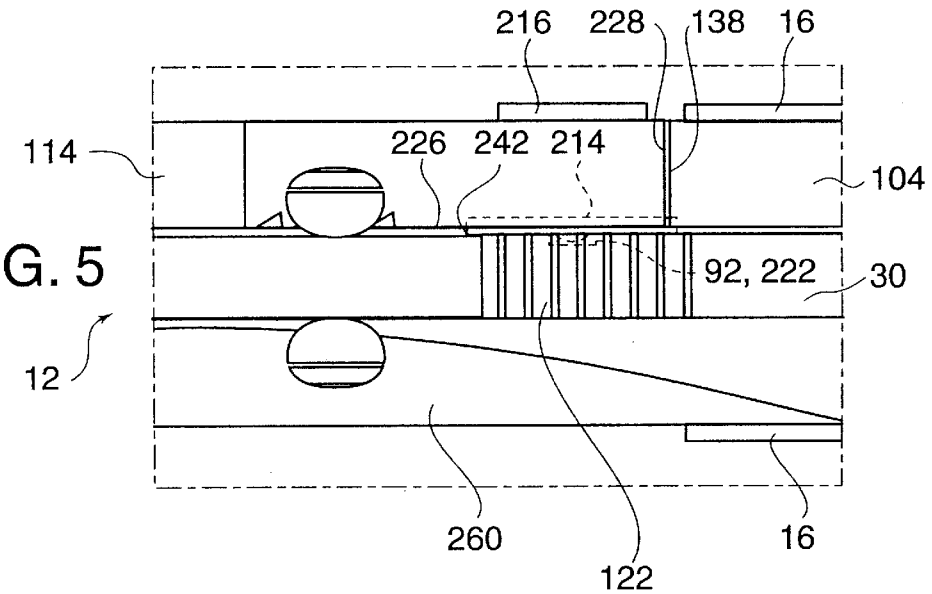
FIG. 5 is an enlarged bottom view of the preferred embodiment taken along line 5—5 of FIG. 4 but shown fully assembled.

Referring to FIG. 5, as aforementioned, free end 114 of spring 106 is pre-stressed to be biased inwardly (downwardly in FIG. 5), so that hemispherical tip 222 of locking mechanism 121 is biased toward tang 30. Blind hole 92 is positioned on side 52 of tang 30, the side facing locking mechanism 121, such that when blade 12 is fully folded, hemispherical tip 222 nests therewithin, as is indicated in phantom in FIGS. 4–5. Tip 222 and blind hole 92 act as a spring-loaded detent (biased together by spring 106) maintaining blade 12 in the closed position. More than a casual force rotating blade 12, in the clockwise direction as seen in FIG. 4, is needed to cam tip 222 out of blind hole 92. In other words, knife 10 is forcibly constrained, but not positively locked, in the closed state. The diameter of blind hole 92 is slightly larger than the diameter of tip 222, permitting rounded tip 222 to rest completely within hole 92. Thus, outer face 240 of disc 214 is pressed flush against side 52 of tang 30, due to the inward bias of spring 106. Since, as explained above in connection with FIGS. 15–16, protruding portion 242 of disc 214 extends beyond recess 238 a predetermined distance, interiorly facing surface 226 of spring 106 is spaced away from side 52 of blade 12, thereby preventing wear on surface 226 and substantially aligning facing end surface 228 of free end 114 with back edge 138 of pivot end 104 of side panel 94. A few other elements, e.g., pivot pin 16, undulating bottom edge 122, and locking mechanism head 216, are also indicated in FIG. 5 for clarity.

Figure 7:
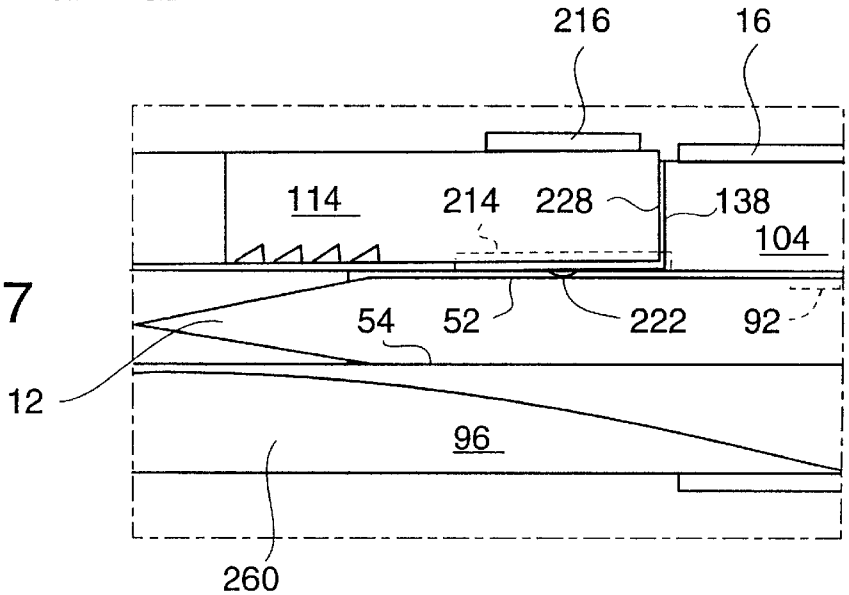
FIG. 7 is an enlarged bottom view taken along line 7—7 of FIG. 6 but shown fully assembled.

FIGS. 6 and 7 show knife 10 in a partially opened state, with blade 12 slightly less than half unfolded. Spring 106 has been flexed outwardly (into the paper in FIG. 6, upwardly in FIG. 7) by hemispherical tip 222 camming out of blind hole 92 as blade 12 is rotated clockwise as seen in FIGS. 4 and 6. Since tip 222 is riding on side 52 of tang 30, facing end surface 228 has been lifted slightly out of alignment with back edge 138 of pivot end 104. Movement of blade 12 is hindered principally by the sliding friction of tip 222 pressing against side 52.

Figure 8:
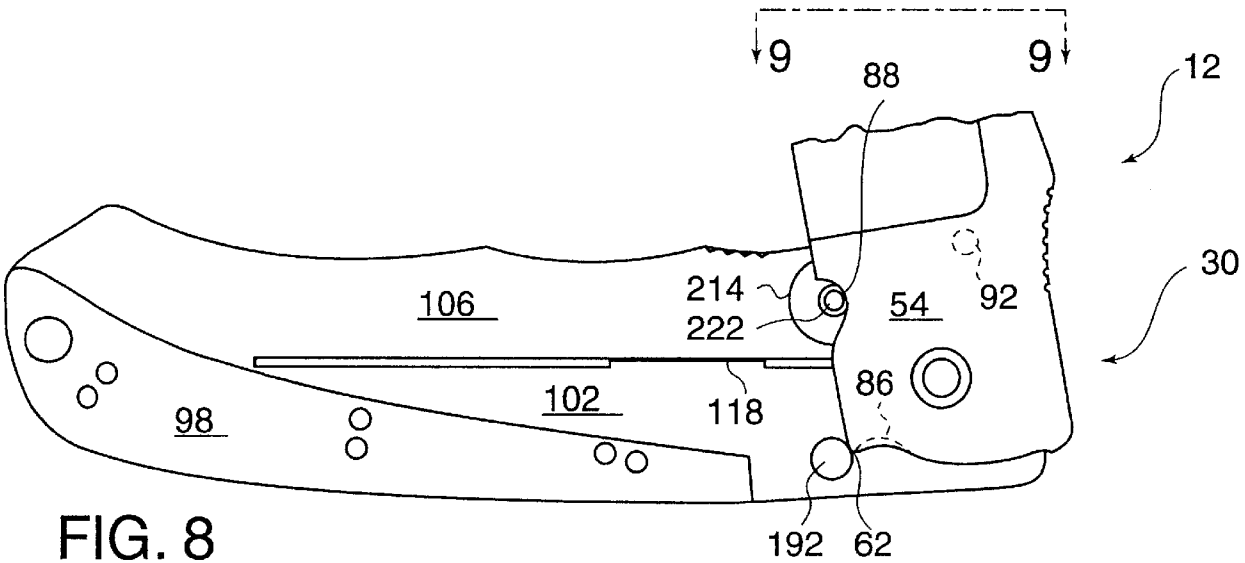
FIG. 8 is similar to FIG. 6 but showing the blade half opened.
Figure 9:
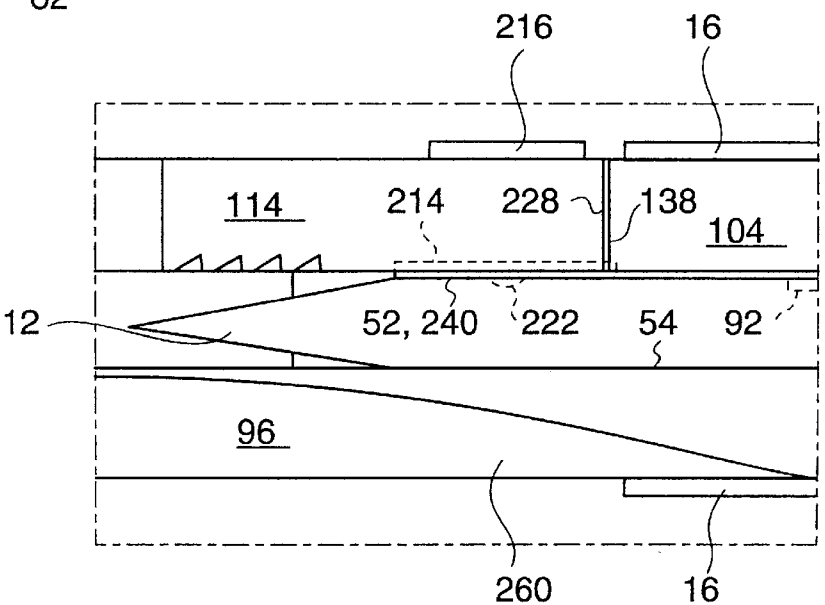
FIG. 9 is an enlarged bottom view taken along line 9—9 of FIG. 8 but shown fully assembled.

Knife blade 12 is shown as half opened in FIGS. 8–9 at which point tip 222 has just slipped off side 52 of tang 30 into arcuate notch 88. The outer face 240 of disc 214 has come into frictional engagement with side 52 which increases the resistance to further opening of blade 12. It can be clearly seen that stop pin 192 is positioned such that corner 62 of tang 30 just clears pin 192 as they pass.

When blade 12 is being closed (the reverse of the steps shown in FIGS. 4 through 11), tip 222 again acts as a detent, this time in association with the edge of notch 88, constraining but not preventing blade 12 from closing. The result is that blade 12 is effectively prevented from closing accidentally onto the fingers of the user.

Figure 10:
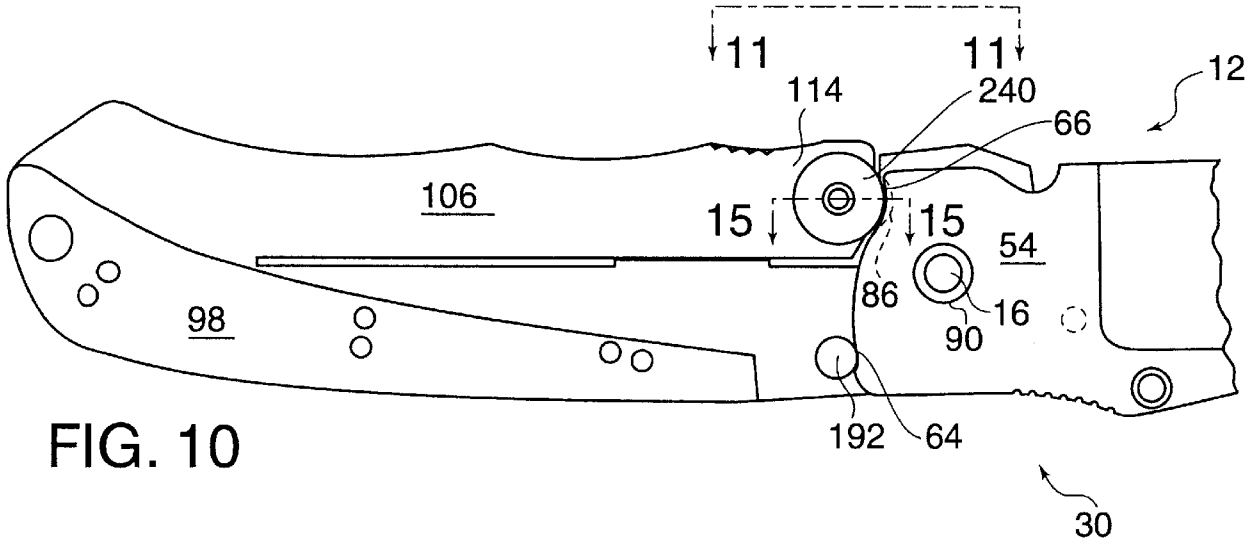
FIG. 10 is similar to FIG. 8 but showing the blade fully opened.
Figure 11:
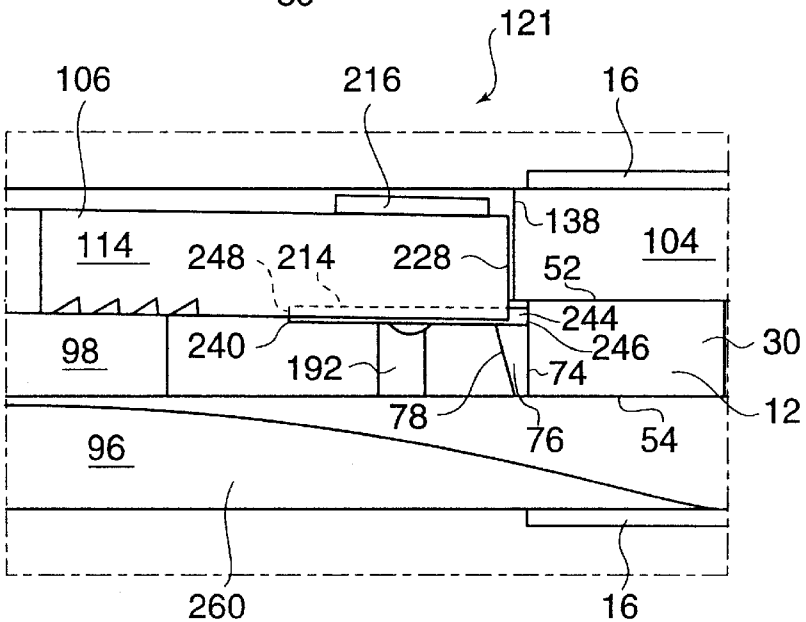
FIG. 11 is an enlarged bottom view taken along line 11—11 of FIG. 10 but shown fully assembled.

FIGS. 10–11 show blade 12 in its fully opened state. Surface 240 of disc 214 has just slipped off side 52 of tang 30 into conical recess 66. Simultaneously, blade-stop recess 64 seats firmly against stop pin 192. The bias of spring 106 forces disc 214 inwardly behind the end of the facing surface 74 of end 26 of tang 30. Chordal segment 244 descends into conical recess 66 and is wedged against the surface of asymmetrically curved depression 76. The diameter of disc 214 and the angle of slope of depression 76 are selected such that the portion of annular surface 246 within chordal segment 244 will fully confront conical depression 76. The thickness of disc 214, however, is much less than the thickness of tang 30, as can be seen in FIG. 11. Thus, chordal segment 244 will descend as far into conical recess 66 as the bias of spring 106 can force it. Blade 12 is locked between two points: (1) disc 214 against depression 76, and (2) blade-lock recess 64 against stop pin 192.

In view of the foregoing, the coaction of disc 214 and conical depression 76 is believed to be an important feature of the present invention. As the perimeter 248 of disc 214 wears down with continued use, chordal segment 244 will merely seat further into conical depression 76, remaining all the while behind and in alignment with tang 30. The life of locking mechanism 121, and the reliability of being able to securely lock blade 12, are thereby vastly increased.

FIGS. 13 and 14 illustrate a second embodiment of the present invention wherein like reference numerals represent identical or corresponding parts.

The second embodiment differs principally from that already discussed in the shape of the wear-resistant end portion 210. Instead of being a circular disc like disc 214, end portion 210 comprises a rectangular plate 250 secured by mounting screw 208 in the same manner as previously disclosed. The coacting blade lock recess 252 in this embodiment preferably comprises a transverse inclined ramp 254 carved orthogonally, relative to side 52 of tang 30, into facing surface 74 of end 26. When blade 12 is opened, a segmental portion 256 of plate 250 drops off side 52 into wedging contact with incline 254, securely locking blade 12 in a similar manner as before.

The use of the side panel of the handle as a locking spring reduces production costs relative to prior art blade locks. Every folding knife needs side panels for aesthetics, safety, and durability. Making the locking spring integral with a side panel removes the prior necessity of providing an additional element as the locking spring.

Even more particularly, incorporating locking spring 106 into side panel 94 makes the locking mechanism both more accessible and safer than prior similar laterally moving spring lock mechanisms. Inasmuch as blade 12 is locked by the inward movement of spring 106, the locking action is reinforced when knife 10 is in use. Squeezing of handle 14 further forces spring 106 and concomitantly locking mechanism 121 into its locking position. This benefit cannot be realized with prior art blade-locks utilizing a laterally moving locking spring, such as Walker and Chen, dicussed previously, since the locking spring of such prior art is located internally of the handle, behind the side panels. No amount of handle squeezing can apply forces to their springs and thereby cannot affect the locking action at all. McLay, also discussed previously, discloses an external, laterally moving locking spring, but it is counter-productive, since squeezing the back of his spring will actually unlock the blade.

Figure 3:
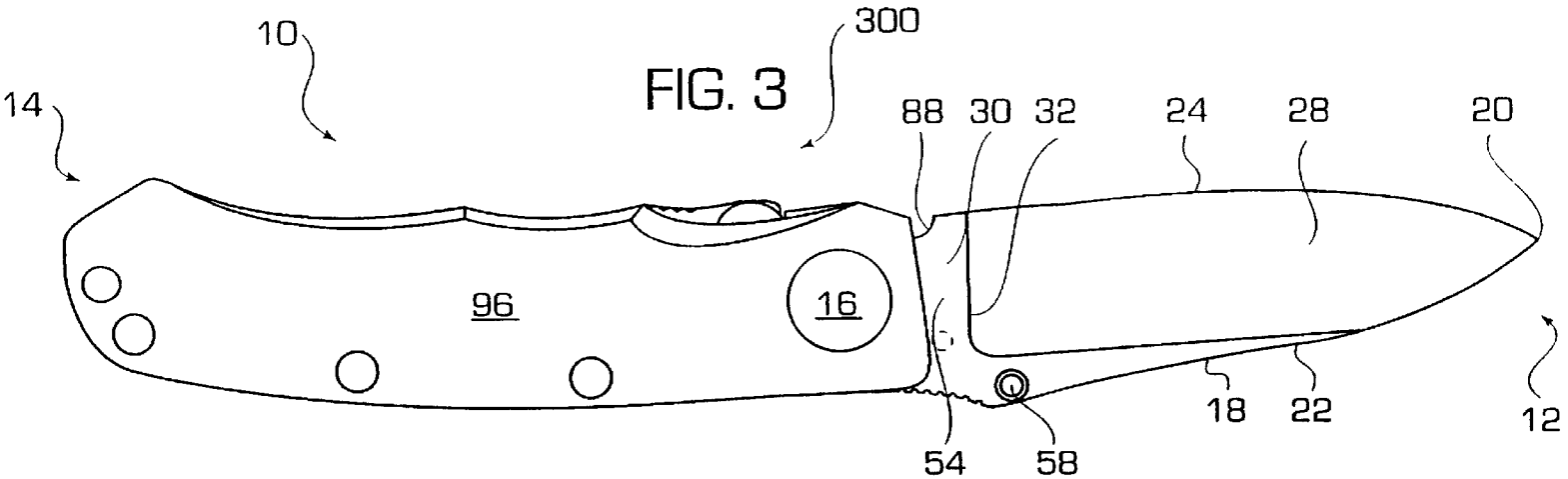
FIG. 3 is a rear side view of the preferred embodiment taken along line 3—3 of FIG. 2.

When it is desired to unlock blade 12, one merely has to deflect the free end 114 of spring 106 laterally in the direction of arrow 258 in FIG. 2. Chordal segment 244 is thereby moved out of alignment with tang 30, thus allowing blade 12 to fold into the closed state of FIG. 4. Lateral deflection of spring 106 is accomplished by pressing one's thumb on the exposed portion 300 of free end 114 and disc 214 (FIG. 3). An enlarged indentation 260 (FIGS. 2, 5, 7, 9, 11, and 14) in side panel 96 facilitates the unlocking operation.

The production costs are further reduced by the use of a replaceable end portion as the locking element. The locking element, where the wear occurs, is preferably a more wear-resistant material than side panel materials; consequently, they tend to be expensive. By replaceably affixing the locking mechanism to side panel 94, side panels 94 and 96 can be made of a less expensive material more suited for decorative purposes.

In addition, selecting a disc as the preferred shape of the end portion further minimizes manufacturing costs, since discs are a relatively inexpensive shape to mass produce.

It is clear from the above that the objects of the invention have been fulfilled.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention as defined in the appended claims.

Further, the purpose of the foregoing Abstract is to enable the U.S. Pat. and Trademark Office, and the public generally, and especially the scientists, engineers and practitioners in the art who are not familiar with Pat. or legal terms or phraseology, to determine quickly from a cursory inspection the nature and essence of the technical disclosure of the application. The Abstract is neither intended to define the invention of the application, which is measured solely by the claims, nor is intended to be limiting as to the scope of the invention in any way.

It can be seen from the above that an invention has been disclosed which fulfills all the objects of the invention. It is to be understood, however, that the disclosure is by way of illustration only and that the scope of the invention is to be limited solely by the following claims:

We claim as our invention:

1. A folding knife, comprising:

a blade having a tip, a pivot end opposite said tip, said pivot end having an end surface, and said blade further including a tang, a first side panel being bifurcated by a longitudinally extending slot into a first portion and a second portion, and said first side panel forming part of an outer, exposed surface against which a hand of a user normally rests, said slot extending to said outer exposed surface;

a second side panel;

said first portion of said first side panel and said second side panel being interconnected so as to form a handle to which said blade is pivotally joined;

said second portion of said first side panel comprising a spring and a locking mechanism, said spring being free to flex laterally relative to said handle to bring said locking mechanism into locking engagement with said end surface when said blade is in a fully unfolded position; and said locking mechanism including an end portion, said end portion being made of a wear-resistant material.

2. The folding knife of claim 1, wherein said end portion is made of metal.

3. The folding knife of claim 1, wherein said rear edge includes a locking recess, and said end portion seats against said locking recess when said blade is rotated into said fully unfolded position.

4. The folding knife of claim 3, wherein said end portion comprises a circular disk.

5. The folding knife of claim 4, wherein said locking recess comprises a conical recess.

6. The folding knife of claim 3, wherein said end portion comprises a rectangular plate.

7. The folding knife of claim 6, wherein said locking recess comprises an inclined ramp.

8. The folding knife of claim 3, wherein said tang further includes a blade stop recess along said rear edge and said handle further comprises a stop pin fixed therewithin, said stop pin forcibly contacting said blade stop recess when said blade is in said fully unfolded position, said blade stop recess being spaced from said locking recess.

9. The folding knife of claim 1, wherein said first side panel further comprises a ridge for guiding contact between said spring and said second portion.

10. The folding knife of claim 1, wherein said tang further comprises a substantially planar side portion having a hole formed thereon;

said end portion further comprising a tip;

said hole being slightly larger in diameter than said tip of said end portion; and said tip of said end portion nesting within said hole when said blade is in a fully folded position.

11. The folding knife of claim 10, wherein said end portion comprises a mounting screw formed of a single piece of material and said tip of said end portion comprises a portion of said mounting screw.

12. The folding knife of claim 1, wherein said first side panel comprises a single piece of material with said first and second portions fashioned integrally therefrom.

13. The folding knife of claim 1, wherein said end surface forming said rear edge of said tang is remote from said tip.

14. The folding knife of claim 1, wherein said flexing of said spring is directed inwardly of said handle.

15. The folding knife of claim 1, wherein said first side panel comprises plastic.

16. The folding knife of claim 1 wherein said end portion is removable.

17. A folding knife comprising:

a handle;

a blade pivotally joined to said handle, said blade including a tang, said tang having a rear edge;

a locking recess formed along said rear edge of said tang;

a spring member having a free end;

a circular disk located at said free end of said spring member;

said circular disk and said locking recess being complimentary in shape; and said spring member being biased so that said circular disc seats against said locking recess when said blade is rotated into a fully unfolded position.

18. The folding knife of claim 17, wherein said locking recess comprises a conical recess.

19. The folding knife of claim 17, wherein said locking recess comprises a conical an inclined ramp.

20. The folding knife of claim 17, wherein said end portion is removable from said spring member.

21. The folding knife of claim 17, wherein said spring member further comprises a ridge for guiding movement of said spring member.

22. The folding knife of claim 17, wherein said tang further includes a blade stop recess along said rear edge and said handle further comprises a stop pin fixed therewithin, said stop pin forcibly contacting said blade stop recess when said blade is in said fully unfolded position, said blade stop recess being spaced from said locking recess.

23. The folding knife of claim 17, wherein said tang further comprises a substantially planar side portion having a hemispherical blind hole formed thereon;

said end portion further comprising a hemispherical tip;

said blind hole being slightly larger in diameter than said tip; and said tip nesting within said blind hole when said blade is in a fully folded position.

24. The folding knife of claim 23, wherein said end portion comprises a mounting screw formed of a single piece of material and said hemispherical tip comprises a portion of said mounting screw.

25. A folding knife comprising:

a handle;

a blade pivotally joined to said handle, said blade including a tang, said tang having a rear edge;

a locking recess formed along said rear edge of said tang; and a spring member having a free end and a wear-resistant end portion located at said free end;

said spring member being biased so that said end portion seats against said locking recess when said blade is rotated into a fully unfolded position, said end-portion being disc-shaped.

26. The folding knife of claim 25, wherein said disc-shaped end portion comprises a circular disc.

27. The folding knife of claim 26, wherein said circular disc is removable from said spring member.

28. The folding knife of claim 25, wherein said locking recess is conically-shaped.

29. The folding knife of claim 25, wherein said handle includes an outer, exposed surface against which the hand of a user normally rests, and said spring member is integrally formed with said handle as part of said outer, exposed surface.

30. The folding knife of claim 25, wherein said spring member and said end portion are made of different materials.

31. The folding knife of claim 30, wherein said spring member is made of a softer material than said end portion.

32. The folding knife of claim 31, wherein said spring member is made of plastic and said end portion is made of metal.

33. A folding knife comprising:

a handle;

a blade pivotally joined to said handle, said blade including a tang, said tang having a rear edge;

a locking recess formed along said rear edge of said tang; and a spring member having a free end and a wear-resistant end portion located at said free end;

said end portion being removable from said spring member so as to be easily replaceable in the event it wears out;

said spring member being biased so that said end portion seats against said locking recess when said blade is rotated into a fully unfolded position.

34. The folding knife of claim 33, wherein said end portion comprises a circular disc.

35. The folding knife of claim 33, wherein said locking recess is conically-shaped.

36. The folding knife of claim 33, wherein said handle includes an outer, exposed surface against which the hand of a user normally rests, and said spring member is integrally formed with said handle as part of said outer, exposed surface.

37. The folding knife of claim 33, wherein said spring member and said end portion are made of different materials.

38. The folding knife of claim 37, wherein said spring member is made of a softer material than said end portion.

39. The folding knife of claim 38, wherein said spring member is made of plastic and said end portion is made of metal.

40. A folding knife comprising:

a handle having an outer, exposed surface against which the hand of a user normally rests;

a blade pivotally joined to said handle, said blade including a tang, said tang having a rear edge;

a locking recess formed along said rear edge of said tang; and said handle including a spring member integrally formed therewith as part of said outer, exposed surface, said spring member having a free end and a wear-resistant end portion located at said free end;

said spring member being biased so that said end portion seats against said locking recess when said blade is rotated into a fully unfolded position.

41. The folding knife of claim 40, wherein said end portion comprises a circular disc.

42. The folding knife of claim 40, wherein said end portion is removable from said spring member.

43. The folding knife of claim 41, wherein said circular disc is removable from said spring member.

44. The folding knife of claim 40, wherein said spring member and said end portion are made of different materials.

45. The folding knife of claim 44, wherein said spring member is made of a softer material than said end portion.

46. The folding knife of claim 45, wherein said spring member is made of plastic and said end portion is made of metal.

47. The folding knife of claim 40, wherein said locking recess is conically-shaped.

48. A folding knife comprising:

a handle;

a blade pivotally joined to said handle, said blade including a tang, said tang having a rear edge;

a locking recess formed along said rear edge of said tang; and a spring member having a free end and a wear-resistant end portion located at said free end, said spring member and said end portion being made of different materials;

said spring member being biased so that said end portion seats against said locking recess when said blade is rotated into a fully unfolded position.

49. The folding knife of claim 48, wherein said spring member is made of a softer material than said end portion.

50. The folding knife of claim 49, wherein said spring member is made of plastic and said end portion is made of metal.

51. The folding knife of claim 48, wherein said end portion comprises a circular disc.

52. The folding knife of claim 51, wherein said circular disc is removable from said spring member.

53. The folding knife of claim 48, wherein said end portion is removable from said spring member.

54. The folding knife of claim 48, wherein said locking recess is conically-shaped.

55. The folding knife of claim 48, wherein said handle includes an outer, exposed surface against which the hand of a user normally rests, and said spring member is integrally formed with said handle as part of said outer, exposed surface.

56. A folding knife comprising:

a handle having an outer, exposed surface against which the hand of a user normally rests;

a blade pivotally joined to said handle, said blade including a tang; and said handle including a spring member integrally formed therewith as part of said outer, exposed surface, said spring member having a free end and a wear-resistant end portion located at said free end;

said spring member being biased so that said end portion seats against said tang when said blade is rotated into a fully unfolded position.

57. The folding knife of claim 56, wherein said end portion is removable from said spring member.

58. The folding knife of claim 56, wherein said end portion comprises a circular disc.

59. The folding knife of claim 58, wherein said circular disc is removable from said spring member.

60. The folding knife of claim 59, wherein said spring member is made of plastic and said end portion is made of metal.

61. The folding knife of claim 56, wherein said spring member and said end portion are made of different materials.

* * * * *